US008960468B2

(12) United States Patent
Boivin

(10) Patent No.: US 8,960,468 B2
(45) Date of Patent: Feb. 24, 2015

(54) COLLAPSIBLE CONTAINER

(75) Inventor: Mathieu Boivin, Ville-St-Laurent (CA)

(73) Assignee: Norduyn Inc., Montreal (CA)

( * ) Notice: Subject to any disclaimer, the term of this patent is extended or adjusted under 35 U.S.C. 154(b) by 1013 days.

(21) Appl. No.: 12/234,603

(22) Filed: Sep. 19, 2008

(65) Prior Publication Data

US 2009/0078700 A1 Mar. 26, 2009

Related U.S. Application Data

(60) Provisional application No. 60/974,061, filed on Sep. 20, 2007.

(51) Int. Cl.
*B65D 8/14* (2006.01)
*B65D 19/42* (2006.01)

(52) U.S. Cl.
CPC ..... *B65D 19/42* (2013.01); *B65D 2519/00233* (2013.01); *B65D 2519/00273* (2013.01); *B65D 2519/00502* (2013.01); *B65D 2519/00606* (2013.01); *B65D 2519/00611* (2013.01); *B65D 2519/00661* (2013.01); *B65D 2519/00691* (2013.01); *B65D 2519/00711* (2013.01); *B65D 2519/00781* (2013.01); *B65D 2519/00786* (2013.01); *B65D 2519/00925* (2013.01)
USPC ..... 220/4.28; 220/4.31

(58) Field of Classification Search
USPC ..... 220/4.28, 4.33, 4.31, 4.34, 6, 666, 7; 206/600; 29/700
See application file for complete search history.

(56) References Cited

U.S. PATENT DOCUMENTS

| | | | | |
|---|---|---|---|---|
| 3,327,654 | A * | 6/1967 | Duncan et al. | 108/53.1 |
| 3,463,343 | A * | 8/1969 | Asenbauer | 220/8 |
| 3,618,806 | A | 11/1971 | Coleman | |
| 3,651,974 | A * | 3/1972 | Barry et al. | 220/1.5 |
| 3,746,203 | A | 7/1973 | Cipolla | |
| 3,840,135 | A | 10/1974 | Bridge | |
| 3,853,239 | A | 12/1974 | Meller | |
| 3,907,147 | A | 9/1975 | Goobeck | |
| 3,915,327 | A | 10/1975 | Lovich | |
| 3,968,895 | A | 7/1976 | Barnes | |
| 4,063,227 | A | 12/1977 | Petersen | |
| 4,162,737 | A | 7/1979 | Clive-Smith | |

(Continued)

FOREIGN PATENT DOCUMENTS

| | | |
|---|---|---|
| EP | 0136258 | 4/1985 |
| EP | 0255194 | 2/1988 |

(Continued)

*Primary Examiner* — Jeffrey Allen
(74) *Attorney, Agent, or Firm* — Mathieu Audet

(57) ABSTRACT

A collapsible container having an expanded storage configuration and a collapsed storage configuration is provided, the collapsible container comprising a floor portion; a ceiling portion opposed to the floor portion; at least one wall portion disposed between the floor portion and the ceiling portion; at least one door portion disposed between the floor portion and the ceiling portion; and at least two posts having a collapsed length configuration and an expanded length configuration, the at least two posts, in the collapsed length configuration, being adapted to interconnect the ceiling portion to the floor portion when the container is in the collapsed configuration and, in the expanded length configuration, being adapted to interconnect the ceiling portion to the floor portion when the container is in the expanded configuration. A collapsible container kit and a method of using the collapsible container is also provided.

20 Claims, 16 Drawing Sheets

(56) References Cited

U.S. PATENT DOCUMENTS

| | | | | |
|---|---|---|---|---|
| 4,538,663 | A | 9/1985 | Looker | |
| 4,577,772 | A | 3/1986 | Bigliardi | |
| 4,618,068 | A | 10/1986 | Born | |
| 4,638,744 | A | 1/1987 | Clive-Smith | |
| 4,726,486 | A | 2/1988 | Masuda | |
| 4,746,059 | A | 5/1988 | Jackson | |
| 4,747,504 | A | 5/1988 | Wiseman | |
| 4,893,746 | A | 1/1990 | Swanhart | |
| 5,253,763 | A | 10/1993 | Kirkley | |
| 5,289,933 | A * | 3/1994 | Streich et al. | 220/1.5 |
| 5,449,082 | A | 9/1995 | Reynard | |
| 5,454,597 | A | 10/1995 | Thomas | |
| 5,501,353 | A | 3/1996 | Warren | |
| 5,595,431 | A | 1/1997 | Mlakar | |
| 5,865,334 | A | 2/1999 | Ruiz | |
| 5,890,612 | A | 4/1999 | Coppi | |
| 5,941,405 | A | 8/1999 | Scales | |
| 5,961,173 | A | 10/1999 | Repetti | |
| 5,979,684 | A | 11/1999 | Ohnishi | |
| 6,047,588 | A | 4/2000 | Danilychev | |
| 6,112,929 | A | 9/2000 | Ota | |
| 6,155,772 | A | 12/2000 | Beale | |
| 6,206,623 | B1 | 3/2001 | Podd | |
| 6,220,468 | B1 | 4/2001 | Lee | |
| 6,227,397 | B1 * | 5/2001 | Kim | 220/8 |
| 6,299,009 | B1 | 10/2001 | Ryziuk | |
| 6,511,018 | B1 | 1/2003 | Parson | |
| 6,824,338 | B2 | 11/2004 | Looker | |
| 6,974,164 | B2 | 12/2005 | Brewster | |
| 7,088,257 | B2 | 8/2006 | Weekes | |
| 7,104,425 | B2 | 9/2006 | Le Roy | |
| 7,121,601 | B2 | 10/2006 | Mulvihill | |
| 7,156,273 | B2 | 1/2007 | Morris | |
| 7,165,484 | B2 | 1/2007 | Wang | |
| 2003/0127456 | A1 * | 7/2003 | Brown | 220/4.33 |
| 2004/0007572 | A1 | 1/2004 | Payne | |
| 2004/0188307 | A1 * | 9/2004 | Beck | 206/503 |
| 2005/0000961 | A1 | 1/2005 | Hilders | |
| 2005/0051544 | A1 | 3/2005 | Looker | |
| 2005/0082284 | A1 | 4/2005 | Ouyang | |
| 2005/0099018 | A1 | 5/2005 | Witchey | |
| 2005/0103779 | A1 | 5/2005 | Xie | |
| 2005/0194381 | A1 | 9/2005 | Zupancich | |
| 2006/0011625 | A1 * | 1/2006 | Arnold | 220/6 |
| 2006/0043090 | A1 | 3/2006 | Ferrini | |
| 2006/0164231 | A1 | 7/2006 | Salisbury | |
| 2007/0000921 | A1 | 1/2007 | Butler | |
| 2007/0025832 | A1 | 2/2007 | Rawdon | |

FOREIGN PATENT DOCUMENTS

| | | |
|---|---|---|
| EP | 0273861 | 7/1988 |
| EP | 0451226 | 10/1991 |
| EP | 0520745 | 12/1992 |
| EP | 0549098 | 6/1993 |
| EP | 0679589 | 11/1995 |
| EP | 0716988 | 6/1996 |
| EP | 0737152 | 10/1996 |
| EP | 0822152 | 2/1998 |
| EP | 0846625 | 6/1998 |
| EP | 1061009 | 12/2000 |
| EP | 1528012 | 5/2005 |
| EP | 1707505 | 10/2006 |
| EP | 1724212 | 11/2006 |
| JP | 2001031184 | 2/2001 |
| WO | WO9002084 | 3/1990 |
| WO | WO9103410 | 3/1991 |
| WO | WO9104928 | 4/1991 |
| WO | WO9113818 | 9/1991 |
| WO | WO9304952 | 3/1993 |
| WO | WO9518749 | 7/1995 |
| WO | WO9521084 | 8/1995 |
| WO | WO9812496 | 3/1998 |
| WO | WO9928215 | 6/1999 |
| WO | WO0176960 | 4/2001 |
| WO | WO0158788 | 8/2001 |
| WO | WO0226594 | 9/2001 |
| WO | WO0183327 | 11/2001 |
| WO | WO0183328 | 11/2001 |
| WO | WO0183329 | 11/2001 |
| WO | WO0248009 | 12/2001 |
| WO | WO2004052754 | 12/2002 |
| WO | WO03035492 | 5/2003 |
| WO | WO2004009453 | 1/2004 |
| WO | WO2004024604 | 3/2004 |
| WO | WO2004093024 | 4/2004 |
| WO | WO2004103830 | 5/2004 |
| WO | WO2005025996 | 3/2005 |
| WO | WO2005090121 | 3/2005 |
| WO | WO2006009512 | 1/2006 |
| WO | WO2006020927 | 2/2006 |
| WO | WO2006021734 | 3/2006 |
| WO | WO2006119123 | 5/2006 |
| WO | WO2006124403 | 5/2006 |
| WO | WO2006124404 | 5/2006 |
| WO | WO2006129002 | 12/2006 |
| WO | WO2007008815 | 1/2007 |

* cited by examiner

COLLAPSIBLE CONTAINER

CROSS-REFERENCE

The present U.S. Patent Application relates to and claims priority from U.S. Provisional Patent Application No. 60/974,061, filed on Sep. 20, 2007, entitled COLLAPSIBLE CONTAINER, which is hereby incorporated by reference.

FIELD OF THE INVENTION

The present invention relates to a container for the transportation of cargo and is particularly concerned with an improved form of a collapsible container.

BACKGROUND OF THE INVENTION

Containers are commonly used to transport cargo with ships, airplanes and trucks. Made of strong material, like steel, the rigid structure has doors on one side by which the container is secured when closed. Conversely, the container is loaded and unloaded when the doors are opened.

In particular, in the military setting a wide variety of logistical support systems are now containerized in order to speed troop deployments. For military applications, structural requirements are significant in terms of acceptable cargo load, acceleration (G forces) and dry weight. Full size containers must be able to carry 8000 pounds of cargo at 3.5 G acceleration in addition to a safety factor of 1.5.

Moreover, in at least one configuration, the container can be air lifted by helicopter or a crane when fully loaded. The container must also be carried by a fork lift. The container must therefore be capable of sustaining the forces applied in different directions (i.e. pulling, supporting).

The container must be dismountable by a limited number of people, without tools, within minutes. The parts of the container must also be interchangeable from one container to another.

On the logistic side, transport requirements are often asymmetric, with more cargo being shipped in one direction than the other. This creates logistical problems because the return transportation of empty containers is often inefficient and costly. Although the containers are lighter when empty, the load volume remains unchanged.

Collapsible containers have been used to decrease the load volume used by the empty containers on the return voyage. Prior collapsible container designs include containers that are disassembled and shipped as a group of components, and containers with folding parts which allow the structure of the container to be folded in a manner that reduces the volume used.

Existing collapsible containers lack strength and durability. The inclusion of folding parts results in a considerably complex structure. Hinges and joints are susceptible to material fatigue and failure and thus increase the risk of dealing with a defective container during critical situations.

The transport of empty containers in a disassembled configuration poses additional problems as the disassembled components require suitable packaging.

A collapsible container that meets the various requirements and avoids the disadvantages detailed above is therefore desirable. It is also desirable to have a container, reducible in volume, easy to manufacture, easy to use, and is reliable.

SUMMARY OF THE INVENTION

It is an object of the present invention to ameliorate at least some of the inconveniences present in the prior art.

In view of the foregoing, one object of the present invention provides a collapsible container that is strong and durable in both an expanded configuration and a collapsed configuration.

An aspect of the present invention provides corner posts connecting the ceiling portion of the container with the floor portion of the container, corner posts in their expanded length state secure the ceiling portion of the container to the floor portion of the container to provide the collapsible container in its expanded configuration. In contrast, the corner posts, in their reduced length, secure the ceiling portion of the container to the floor portion of the container to provide the collapsible container in its collapsed configuration.

Another aspect of the present invention provides corner posts having a mechanism allowing a change in length, either by extending or by removing a section of each post or by replacing the post by another post of a different length, to secure the ceiling portion of the container to the floor portion of the container in both the expanded and the collapsed configuration.

One object of the present invention provides a collapsible container having a structure allowing two persons to transform the collapsible container from the collapsed configuration to the expanded configuration.

Another aspect of the present invention provides a collapsible container in which corner posts provide support for the ceiling portion in the expanded configuration and the collapsed configuration, respectively.

Another object of the present invention provides a collapsible container which may be transported in the expanded configuration or in the collapsed configuration. The transport might be made by lifting the container or by supporting the container.

An object of the present invention provides corner posts suitable to be lifted from their upper end and support the entire weight of the loaded collapsible container in its expanded configuration with a load of about at least 3600 kg (8000 pounds). The loaded collapsible container also need to sustain the load increased by applying accelerations of at least 3.5 G to the container in addition to a 1.5 safety factor.

An aspect of the present invention provides removable corner posts that can be disconnected from the ceiling portion, the floor portion and the wall portions.

One aspect of the present invention provides corner posts made of a lower portion and a upper portion. The upper and the lower portions being secured together to provide a complete full size corner post that is sized to connect the ceiling portion to the floor portion of the collapsible container to define a container in the expanded configuration. Conversely, one of the upper and the lower corner post portions is used to secure the ceiling portion and the floor portion of the container in the collapsed configuration.

An additional aspect of the present invention provides a lifting anchor on top of each corner post suitable to airlift a fully loaded container in the expanded configuration. The lifting anchors at the top and the bottom of each corner post are designed to mate when containers are piled one onto another.

Another aspect of the present invention provides corner posts made of a lower portion and a upper portion secured together with an aeronautical grade clamps. When airlifted, the corner posts are supporting the entire weight of the loaded container.

One additional aspect of the present invention provides a low friction material between the connecting surfaces between the lower portion and the upper portion of the corner posts to prevent any seizure and facilitate the assembly of both lower and upper portions of each corner post.

An aspect of the present invention provides removable doors to access the interior of the container. The doors are supported by a series of easily slidable hinges affixed on the closest corner post. Each door is removed by first opening the door and then lifting the door from the hinges. When the door is lifted the hinges separates in two parts and the door can be removed from the container.

An additional aspect of the present invention provides wall panels made of composite material. Each wall panel has a contour member reinforcing the wall panel and increasing the robustness of the contour of each wall panel. The contour members are sized and designed to fit and slide in an associated slot disposed on the ceiling portion, the floor portion and the corner posts adjacent to the wall panel when the wall panel is installed on the container. Further, each wall is made of many sections to facilitate the removal of the wall panel and the storage of the wall panel inside the container in its collapsed configuration by reducing the size and the weight of the wall panel. The composite material also allows light to come through so it is easier to see inside the container.

Another additional aspect of the present invention provides the container to be stackable one on top of another. A series of container can be stacked either in the expanded and the collapsed configuration. Collapsible containers, when in their collapsed configuration, may be stacked on top of one another and three collapsed containers fit in the same volume as one expanded collapsible container.

One other aspect of the present invention provides a series of anchors inside the container to secure cargo inside the container in both the expanded and the collapsed configuration. A plurality of hooks, attachment rings, ring handles and rails are provided to offer a panoply of fastening possibilities to accommodate cargo of various types, sizes and masses. Retractable foot supports are also disposed along the walls of the container to facilitate reaching cargo disposed high inside the container. Retractable foot supports are also located on the exterior of the container, preferably on the corner posts, for climbing on top of the container.

Another aspect of the present invention provides a series of removable wheels, preferably located under each corner post, to move the container when it is resting on a leveled ground surface. The removable wheels are preferably solid caster wheels to support a fully loaded container. Furthermore, a fastener selectively secures the removable wheel on the container to make sure the wheel will not disconnect from the container when it is not desired.

An aspect of the present invention provides shelves connectors inside the container for securing a plurality of shelves inside the container. The shelves offer additional support for smaller parts and can be fastened thereto. The shelf connectors provide various heights for the securing of the additional shelves in the container so it is possible to choose the right height for the shelf. The shelf connectors are preferably affixed to the interior portion of the corner posts thus transferring weight directly to the corner posts. Additional shelf posts can be installed inside the container, preferably between the doors where the span is longer, to increase the assembly stiffness and prevent any undesirable deflection of the shelves.

Another object of the present invention provides a collapsible container having a dry weight of 580 kg (1275 pounds) or less.

It is another object of the invention to provide an additional safety feature to prevent any unintentional release of the clamps.

Yet another aspect of the present invention provides a collapsible container and a miniature collapsible container having half the size of the collapsible container. The miniature collapsible container preferably has doors on only one side. The miniature collapsible container offering similar functions as the collapsible container.

One aspect of the present invention provides a method for assembling and disassembling a collapsible container.

An aspect of the present invention provides a method for shipping collapsible containers.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

BRIEF DESCRIPTION OF THE DRAWINGS

For a better understanding of the invention as well as other objects and further features thereof, reference is made to the following detailed description to be read in conjunction with the accompanying drawings, where.

DESCRIPTION OF THE INVENTION

Figure 1:
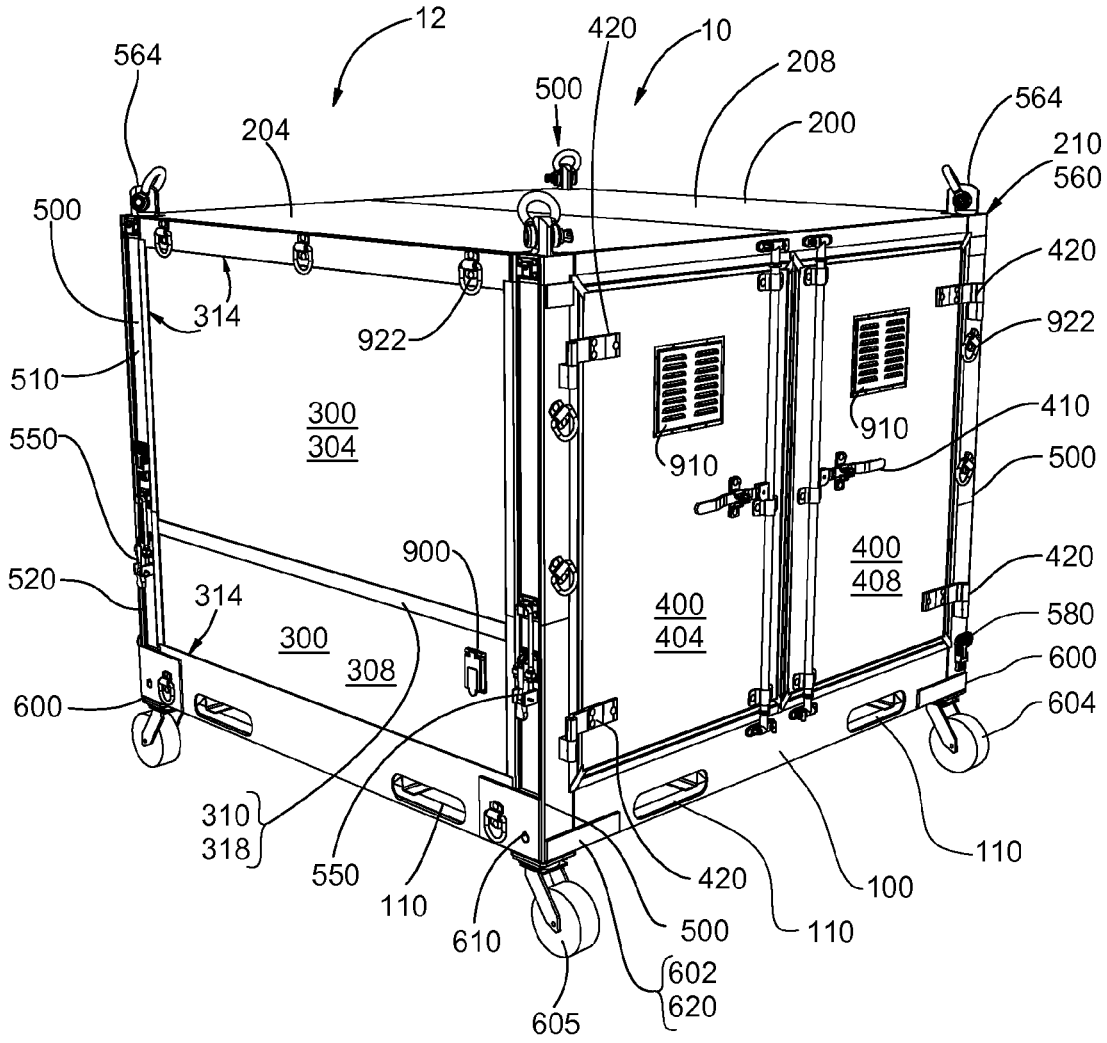
FIG. 1 is a perspective view of a collapsible container, in accordance with the invention, the container being shown in the expanded configuration.

A collapsible container 10 is shown on FIG. 1 in its expanded configuration 12. The container 10 is made of a floor portion 100, a ceiling portion 200, a wall portion 300 and a door portion 400.

Figure 2:
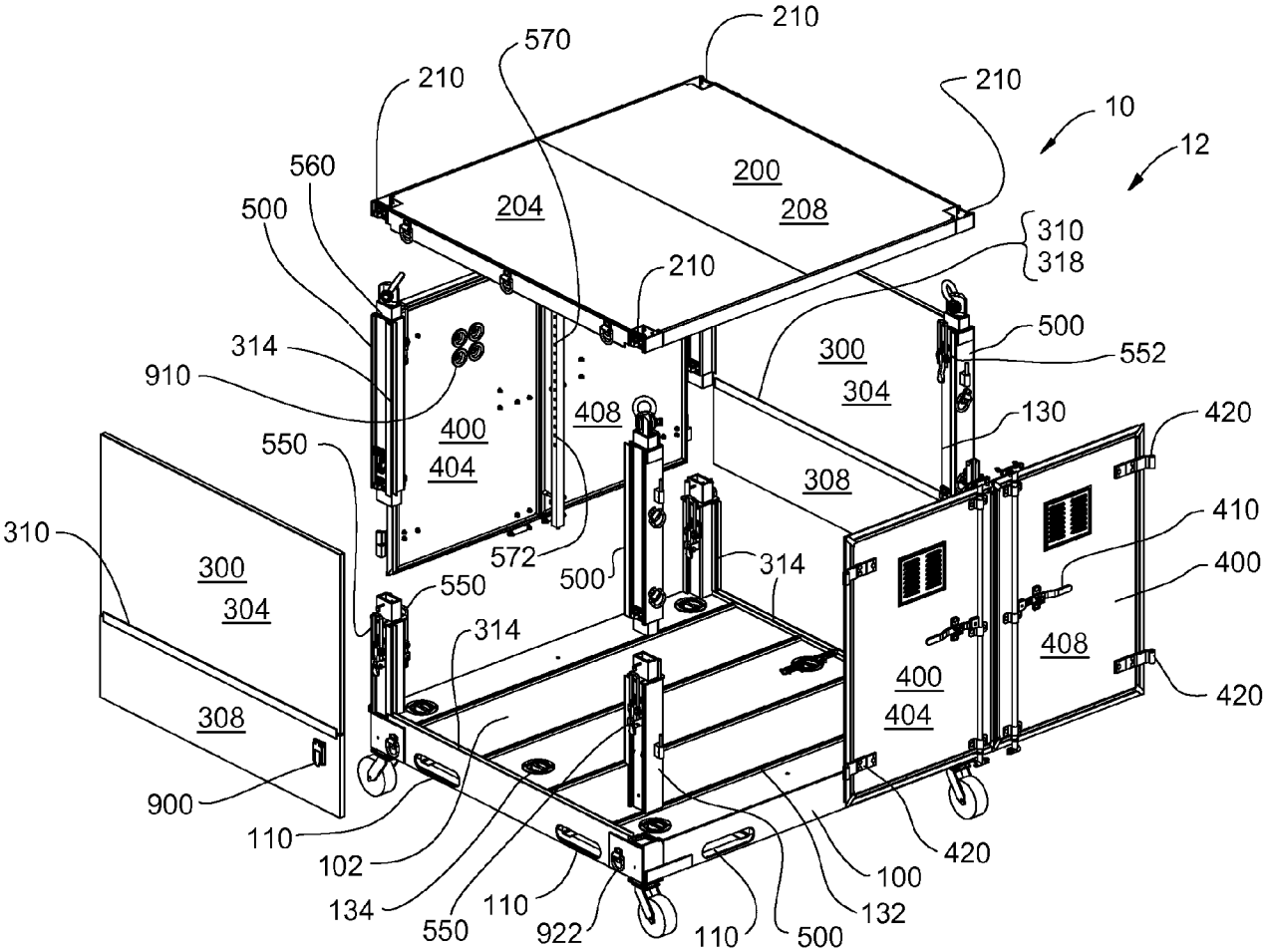
FIG. 2 is a perspective exploded view of the collapsible container of FIG. 1.

As best seen on FIG. 2, the floor portion 100 is preferably covered of anti-slip aluminium sheet material 102 welded or fastened on frame members 106 (shown on FIG. 11) strong enough to support the load carried by the container 10.

The ceiling portion 200 is preferably made of one or two 204, 208 pieces of aluminium sheet material. The wall portion 300 is illustratively made of two panels 304, 308 of composite sheet material. The composite sheet material might be laminated with foam or honeycomb material to increase the strength of the composite sheet. A reinforcement 310 optionally circumscribes each panel 304, 308 to increase the rigidity of the panel 304, 308, prevent any tearing on the sides of the panels 304, 308 and facilitate mating with the groove receptacle 314 along the ceiling 200, the floor 100, the corner posts 500 and the middle panel connector 318 interconnecting two panels 304, 308.

Still referring to FIG. 1 and FIG. 2, the door portion 400 has two doors 404, 408 using a standard locking mechanism 410 commonly used to secure the rear door of a road trailer. Hinges 420 are disposed on each of the doors 404, 408 and connect their closest corner post 500. The configuration of the hinges 420 allow each door 404, 408 to completely open parallel to the corresponding side 300 of the collapsible container 10. Once one door 404, 408 is open the opened door 404, 408 can be removed by lifting the door 404, 408. The hinges will separate by sliding the hinge pivot (not shown) off the female part of the hinge 420. Ventilation openings 910 are also provided in each door 400.

Corner posts 500 are one of the main structural parts of the container 10. They support the ceiling portion 200 and maintain the door portion 400 and the wall portion 300 altogether. They are also strong enough in compression to pile at least one loaded container 10 on top and strong enough in tension to lift a fully loaded container 10. In a preferred embodiment each corner post 500 is made of two distinct sections 510, 520. In the illustrated embodiment the lower section 520 remains fixed to the floor portion 100 while the upper section 510 can be removed. The lower section 520 can be welded or fastened to the floor portion 100.

Aeronautic grade clamps 550 are preferably used to secure both sections 510, 520 of the corner post 500 together. In the present embodiment illustrated on FIGS. 1 and 2, DeStaco clamps model 385-R are used. One of the main advantages of using a claim 550 is to manually disassemble the two post sections 510, 520 without any tool. The post 500 can alternatively be assembled with removable fasteners that would necessitate or not tolls to disconnect the two sections 510, 520 of the post 500. The junction between the upper section 510 and the lower section 520 will be discussed in further details below. Other alternate embodiments allowing a change in length in the posts 500 like using a telescopic mechanism or a hinge-based mechanism to collapse the container 10 are encompassed by the scope of the present description.

The top portion 560 defined on each corner post 500 serves many purposes. Firstly it is designed to receive the ceiling portion 200 by sliding the four corner openings 210 of the ceiling portion 200 over the top portion 560. The ceiling portion 200 is thus positioned by the corner posts 500 and secured in place by a clamp 550 disposed inside the container 10 (not shown on FIG. 1 but visible on FIG. 2). Secondly, each of the top portions 560 defines an anchor 564 for lifting a loaded container 10 with slings (not shown but well known in the art of lifting heavy material). A hole 562 is provided in the anchor 564 to fasten the sling or an intervening fastener thereto. The sling is preferably about "308" centimeters long (140 inches) and connect the anchor 564 with about a 60° angle with the exterior of the ceiling portion 200 to prevent inducing too much stress into the structure of the container 10. The exact recommended sling angle should be verified with the manufacturer before any container lifting is done.

Retractable foot supports 580 are optionally disposed on each corner post 500. Foot supports 580 are convenient for a person to climb on the container 10 or simply to facilitate the installation of the sling 700 to the anchor 564. Fork lift openings 110 are disposed along the structure of the floor 100. The container 10 fork lift openings 110 are engaged by the forks of a fork lift to lift and carry the container 10.

Removable wheels 600 are assembled below each corner post 500. Strong caster wheels 605 are preferably used to support huge loads. A removable locking mechanism 610 fastens the removable wheel 600 in place if the container 10 is lifted from the ground. The locking mechanism 610 is illustratively a pin extending through an opening disposed on the side of the floor portion 100 and adapted to engage a wheel frame 602 on which the caster wheel 600 is rotatably secured. Low friction material 604 (e.g. UHMW) is optionally installed on the surface of the wheel frame 602 interfacing with the container 10. Side channels 620 are adapted to locate the removable wheels 600 at the corner of the container 10, below each corner post 500 to better support the load exercised by other container(s) that can be piled up thereon.

Referring more precisely now to FIG. 2, the container 10 with wall portions 300 removed allows a better illustrative view of the interior of the container 10. A series of shelves (not illustrated) is optionally mounted inside the container 10. The optional shelves, preferably fabricated from a laminated composite material, are reinforced on the sides to improve the stiffness of the shelves and prevent any risk of tearing the edges of a shelf. Each shelf can be secured to the desired height inside the container 10 using fastening tracks 130 disposed, inter alia, along the corner posts 500. The fastening tracks 130 used in the current embodiment are aeronautical grade tracks similar to those commonly used on the interior floor of a passenger aircraft to secure the seats thereupon, although, other fastening mechanism could be used to carry out the present invention. The height and the number of optional shelves inside the container 10 is flexible to accommodate various types and sizes of cargo. Other tracks 132 and rings 134 are disposed on the floor 100 of the container to secure cargo in the container 10.

Internal shelves are optionally adapted to cover half of the surface of the inside of the container 10 to accommodate cargo of uneven sizes. It is also encompassed by the present invention to have shelves covering all the surface 122 inside of the container 10 to receive more cargo. Additional shelf posts 570 with a track adjustment 572 similar to the track 130 are removably installed half way between corner posts 500 to further secure the shelves 120 or simply for limiting the deflection of a full size shelve.

It can be appreciated from FIG. 2 there are two clamps 550 maintaining the integrity of each post 500 between the two post sections 510, 520. One clamp 550 is disposed outside of the container and the other one is disposed inside the container 10 to ensure even load distribution on each post 500 and to prevent any undesirable disassembly of the corner posts 500 when the container 10 is closed and locked. Other clamps 552 disposed on the upper portion of each corner post 500 are securing the ceiling portion 200 to their respective corner post 500. These clamps 550, 552 are disposed inside the container to prevent undesired access from the outside of the container 10.

Figure 3:
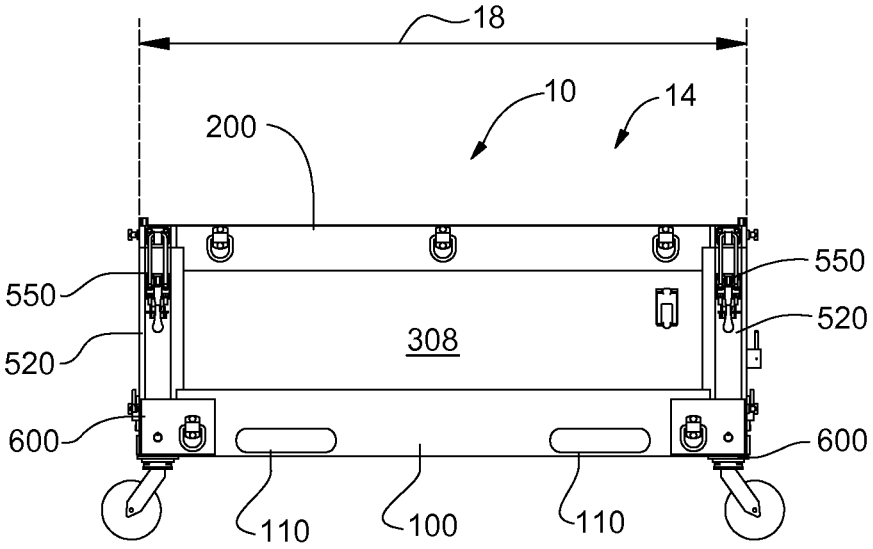
FIG. 3 is a side elevational view of the collapsible container of FIG. 1 in its collapsed configuration.
Figure 4:
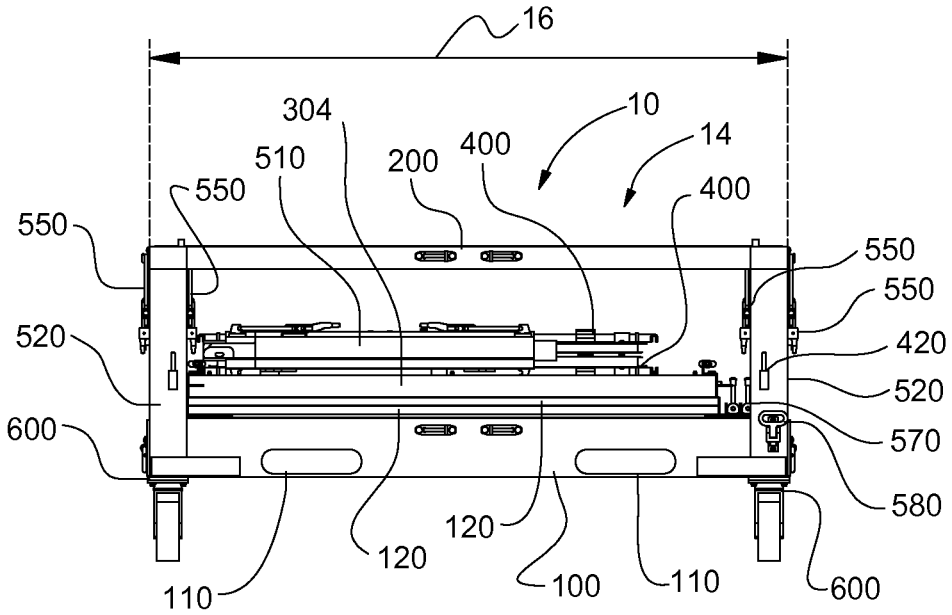
FIG. 4 is a side elevational view of the collapsible container of FIG. 1 in its collapsed configuration.

FIG. 3 and FIG. 4 illustrate the collapsible container 10 in its collapsed configuration 14. Disconnecting the upper portions 510 of the corner posts 500 and connecting the ceiling portion 200 directly on the lower sections 520 provides the collapsed configuration 14. Posts upper sections 510, high wall panels 304, doors 400, wheels 600, shelves 120, shelves post 570, are all disposed on the container floor, ready to be secured thereto. Low wall panels 308 remain in place thus closing two sides of the container 10 to help prevent any container parts to escape the collapsed container 14 when carried. The depth 18 of the container illustrated in the present embodiment is about 210 centimeters. The width 16 of the container illustrated in the present embodiment is about 226 centimeters.

Figure 5:
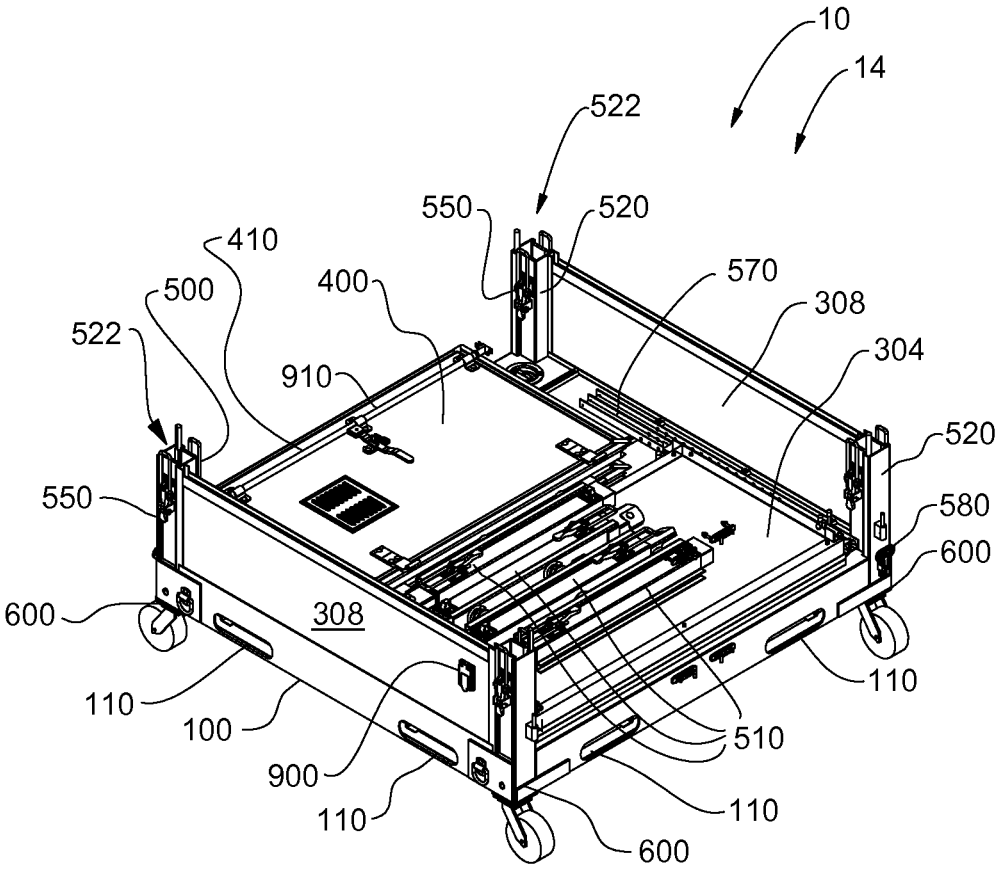
FIG. 5 is a perspective view of a collapsible container, in accordance with the invention, the container being shown in the collapsed configuration with the top portion removed to improve the visibility.

FIG. 5 shows the container of FIG. 3 and FIG. 4 with the ceiling portion 200 removed to better see the internal layout of the various parts of the collapsible container disposed therein. It is apparent that clamps 550 are used to secure the ceiling portion 200 (not shown) to the lower portion 520 of each corner post 500 to bring integrity to the collapsible container in its collapsed configuration 14. It is also apparent that an extended portion 522 of the lower portion 520 of the corner posts 500 is ready to receive the ceiling portion 200 thereon. The extended portion 522 also ensures positioning of the ceiling portion 200 and another collapsible container 10, in either its collapsed configuration or its extended configuration, optionally piled above the collapsible container 10 of FIG. 5 in its collapsed configuration 14.

Figure 6:
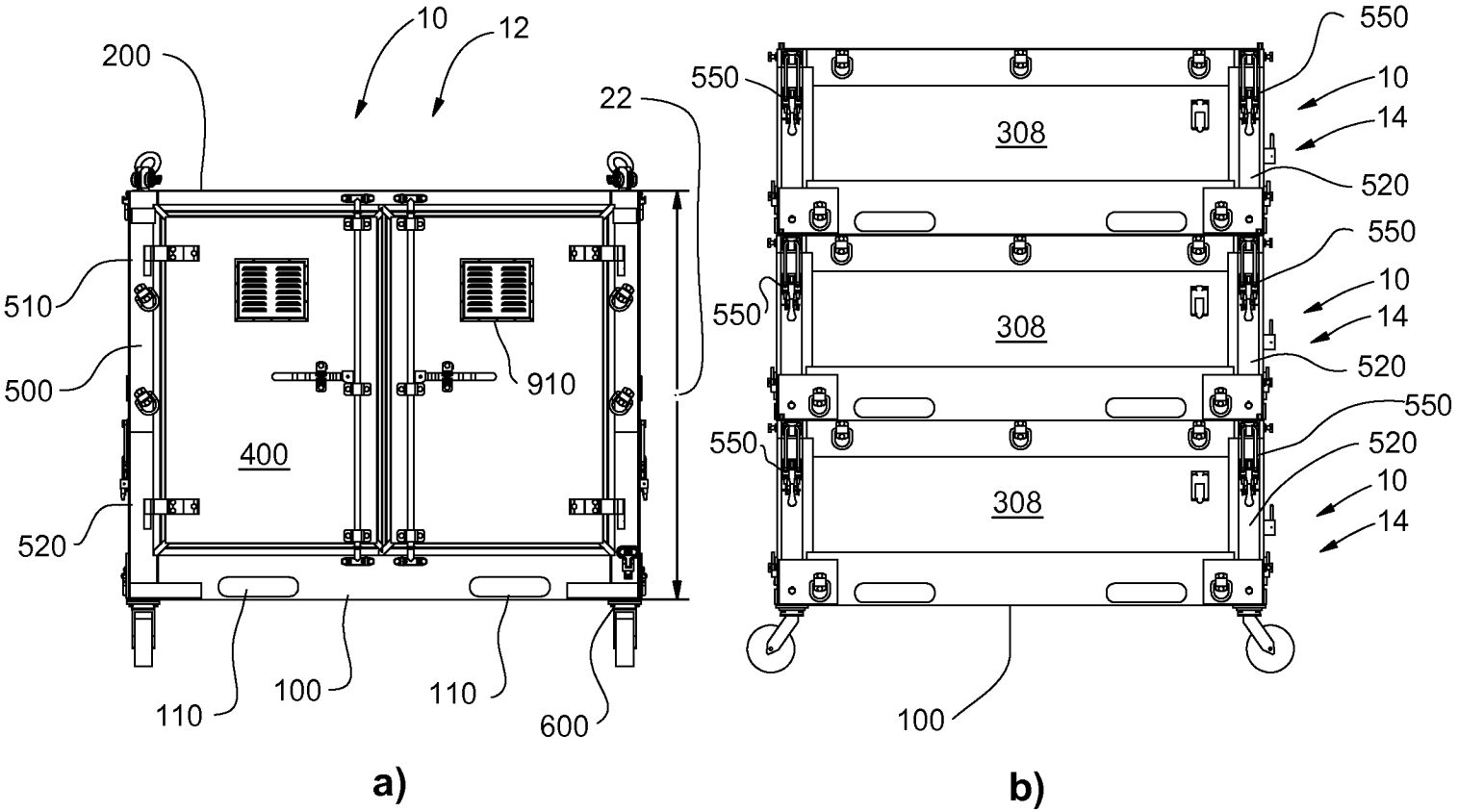
FIG. 6*a*) is a front elevational view of the collapsible container of FIG. 1, FIG. 6*b*) is a side elevational view of a series of stacked collapsible containers in their collapsed configuration, FIGS. 6*a*) and 6*b*) are illustrated side to side to show the difference in height between the two configurations.

FIG. 6*a*) and FIG. 6*b*) illustrate the difference in height between the collapsible container 10 in its expanded configuration 12 (FIG. 6*a*)) and a series of superposed (piled or stacked) collapsed containers 14. At least two collapsed containers 14 can be superposed and have a height less than the height of a single expanded container 12. It is also encompassed by the present invention to superpose three (3) collapsed containers 14 with substantially the same height of a single expanded container 12. This can be obtained by using a different parts layout inside the collapsed container 14 and reducing consequently the height of the lower sections 520 of the corner posts 500 and their associated low wall portions 308.

Figure 7:
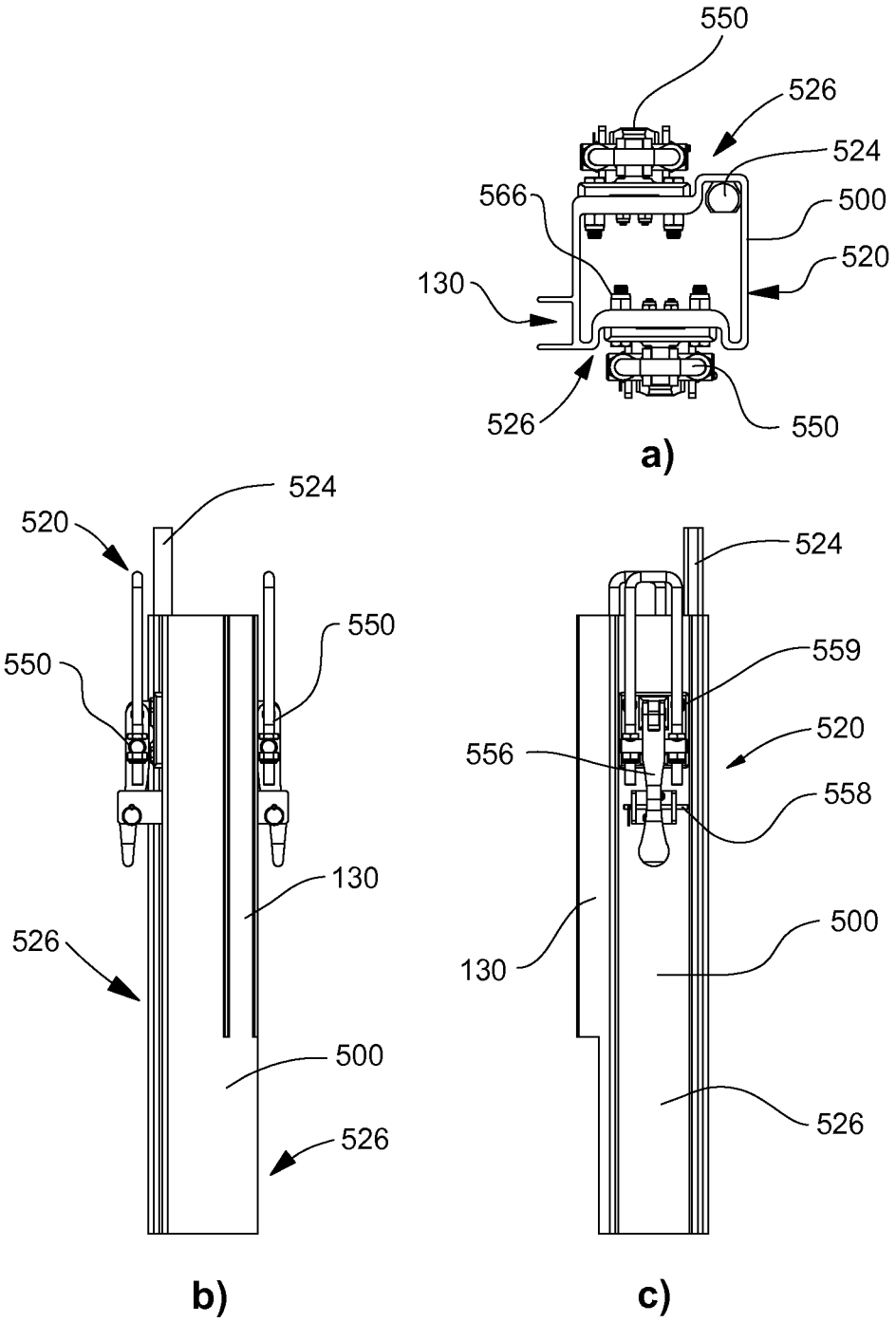
FIGS. 7*a*) is a top plan view, 7*b*) is a side elevational view and 7*c*) is another side elevational view of a lower section of a corner post in accordance with one embodiment of the present invention.

Turning now to FIG. 7*a*) where is illustrated a top plan view of a post's lower section 520. Posts 500 are illustratively embodied as an aluminium extrusion. The extrusion process provides a low cost shaped member that is adapted to the load applied thereon. Alternatively the posts 500 could be made of extruded composite material or simply use welded steel members. The two opposed clamps 550 are secured to the lower section 520 with a series of fasteners 566. It can be appreciated that the opposed clamps 550 are disposed in a respective recessed portion 526 to reduce the width of the post 500 at the level of the clamps 550. The recesses 526 could be more pronounced to provide enough room to receive the entire clamp 550 such that the clamps 550 are not extending over the periphery of the post 500. This substantially reduces the risk of undesirably hitting a clamp 500 with a foreign object when moving the container 10.

Figure 8:
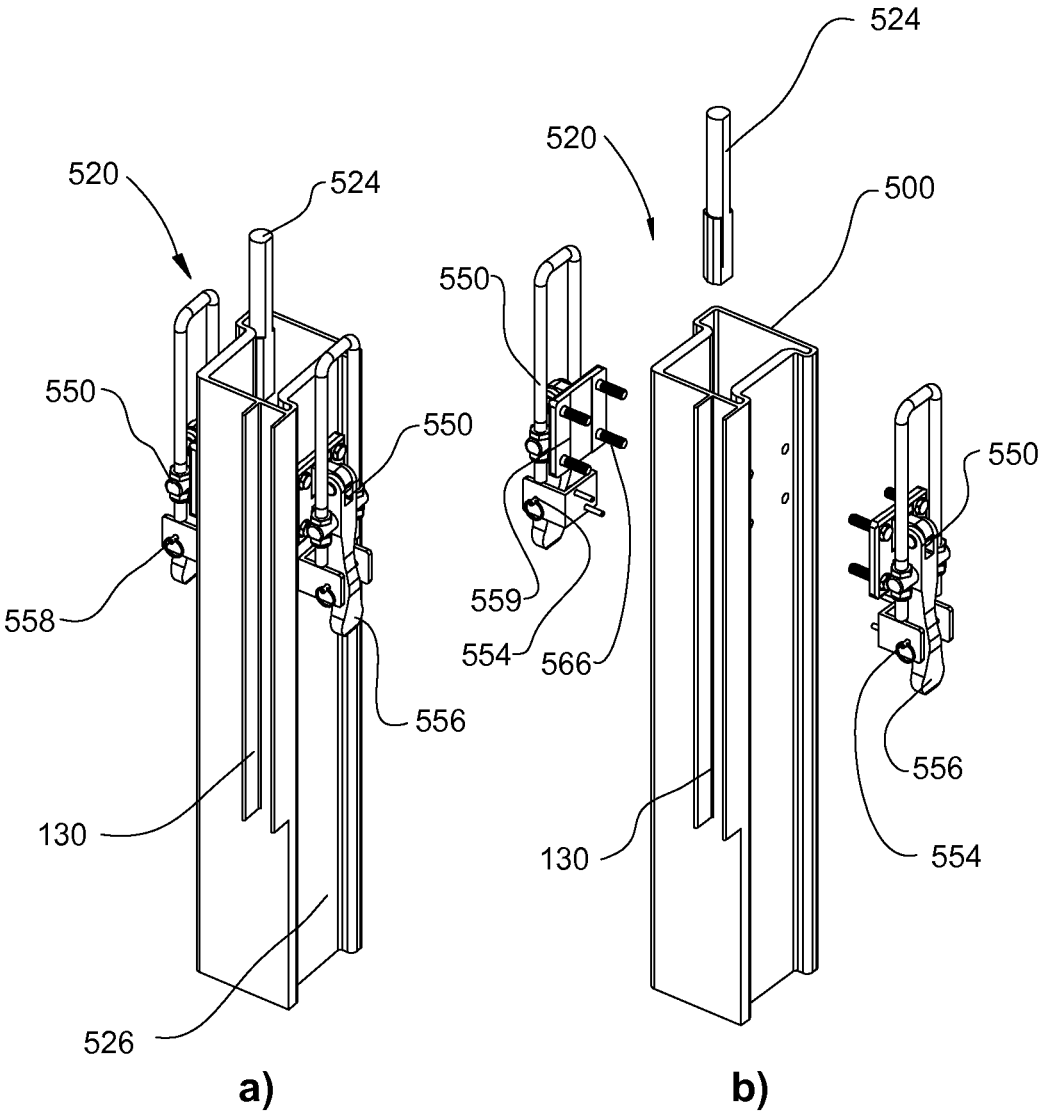
FIGS. 8*a*) and 8*b*) are two perspective views, one assembled and the other exploded, respectively, of the corner post of FIG. 7.

As best seen on FIGS. 7*b*), 7*c*), FIGS. 8*a*) and 8*b*), a centering stem 524 is provided on top of the lower portion 520 and extends above the upper end of the lower portion 520 to center and position the cooperative upper post portion 510 when installed on the lower portion 520. The centering stem 524 is also material in the centering of the ceiling portion 200 when the container 10 is in the collapsed configuration 14. The centering stem 524 is preferably fastened to the lower portion 520 to prevent any undesirable effect caused by the heat generated with a welding process. The stem 524 can be made of steel or hard material to prevent any bending when assembling an upper post portion 510 or a ceiling portion 200 thereon. A fastening track 130 is also provided to the lower portion 520 to receive a wall portion 300 (not shown) therebetween two lower portions 520 disposed on the container 10 floor 100.

It can be appreciated from FIG. 8*a*) and FIG. 8*b*) that the clamp 550 has a build in safety device 554, in the present situation the safety device is a locking pin 554 further securing the clamp 550 lever 556 to the post 550. The locking pin 558 passes through both the lever 556 and the frame of the clamp 550 thus holding the lever 556 to the corner post 500. A second additional safety lock (not shown) can be added to ensure the safety device 554 won't be unintentionally actuated.

Figure 9:
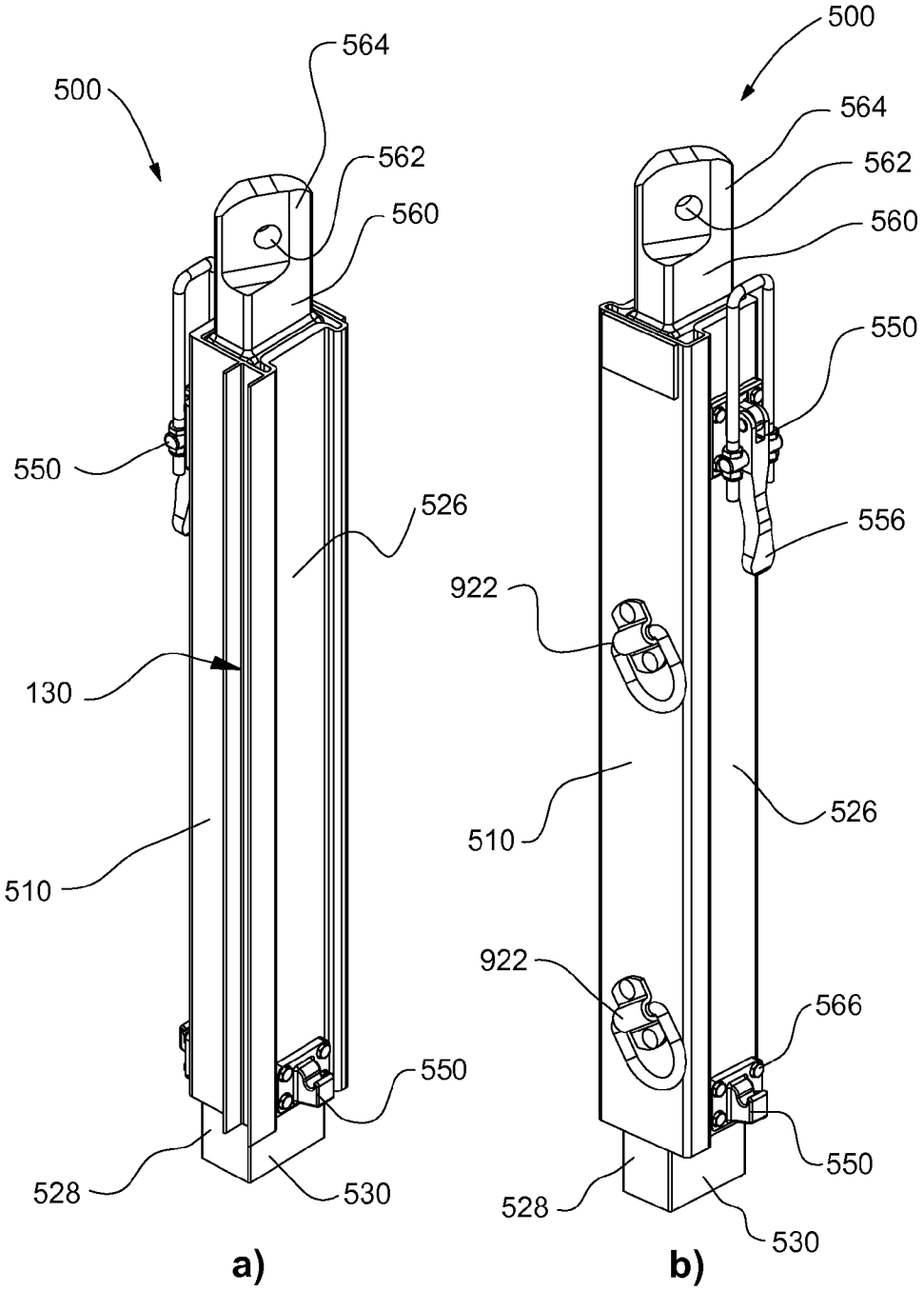
FIGS. 9*a*) and 9*b*) are two opposed perspective views of an upper section of a corner post in accordance with one embodiment of the present invention.
Figure 10:
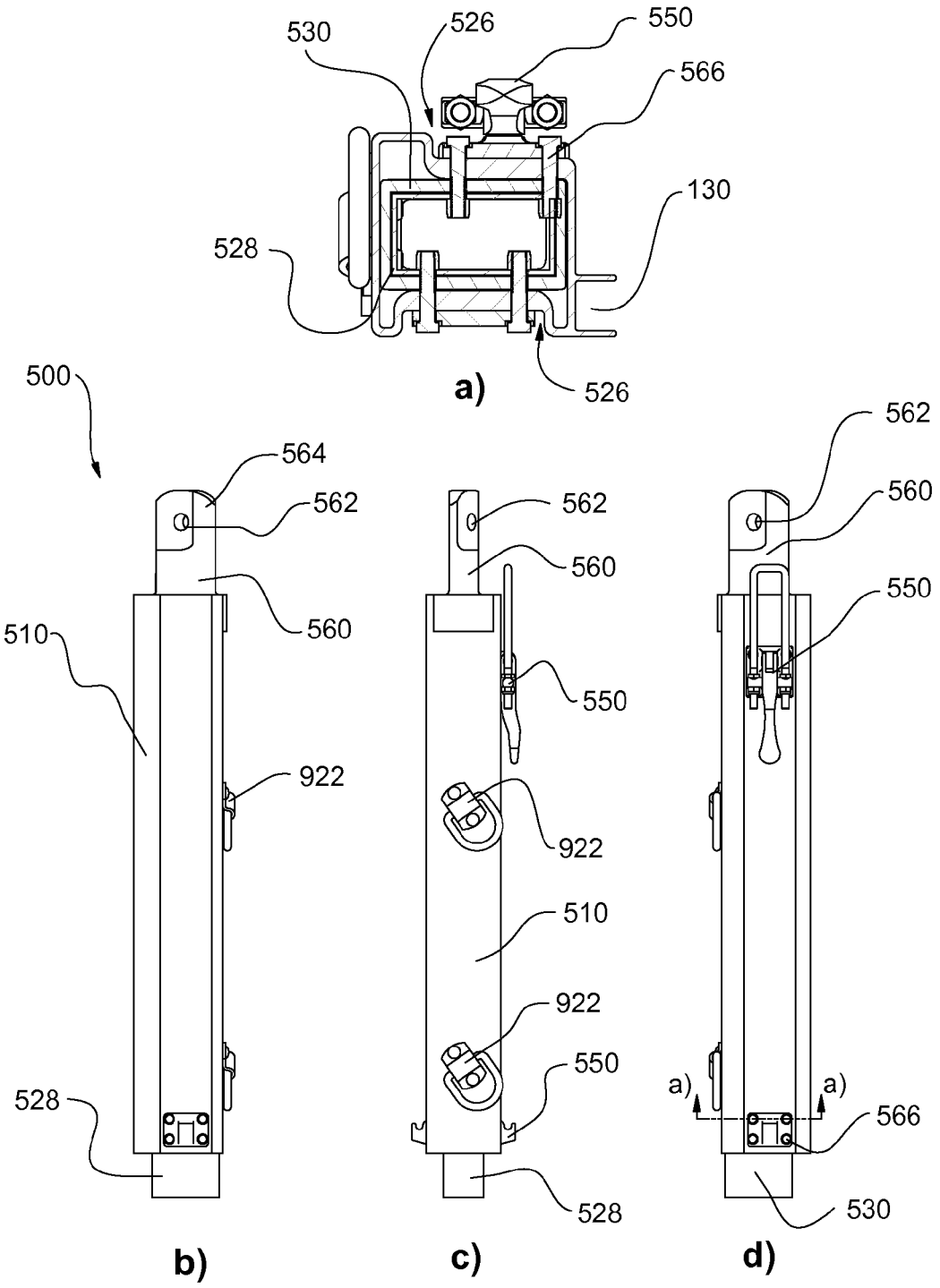
FIG. 10*a*) is a top plan sectional view, FIG. 10*b*) is a side elevational view, FIG. 10*c*) is a complementary side elevational view and FIG. 10*d*) is another complementary side elevational views of an upper section of a corner post.

FIGS. 9*a*) and 9*b*) are illustrating, from different angles, an upper post portion 510. The upper portion 510 is a continuity of the lower portion 520 and is preferably made with the same material and with a cooperating section. The length of the upper portion 510 is defined by the desired height of a collapsed container 14. The upper portion 510 is adapted to be removed easily from its corresponding lower portion 520. Unsecuring the clamps 550 of the lower portion 520 free the upper portion 510. A male-female adaptor 528 is provided on the end of the upper portion 510 that is adapted to mate the lower portion 520. The male-female adaptor 528 is preferably covered with a low friction material 530 to prevent any seizure with the lower portion 520. The upper portion 510 also provides recesses 526 to accommodate the clamps 550 and a fastening track 130 adapted to receive the removable wall portion 300 (not shown on these Figures) therein. As explained above, the upper side of the upper portion 510 is provided with a clamp 550 adapted to secure the ceiling portion 200 from the inside to prevent any removal of the ceiling portion 200 when the container 10 is secured. The upper side also provides a top portion 560 adapted to locate the ceiling portion 200 thereon. An anchor 564 with a hole 562 is provided to lift the container 10 with a sling adapted for this task (for instance with a crane or an helicopter). The strength of all the portions and sections of the corner posts 500 is sized and design to sustain severe uses and support significant loads when the container 10 is full of cargo. Additional rings 922 are installed on the posts 500 (among other places on the container 10) to further secure cargo inside the container 10 or secure the container 10 from the outside. FIGS. 10*a*), *b*) and *c*) are further illustrating the upper portion 510 described above in respect with an embodiment of the present invention.

Figure 11:
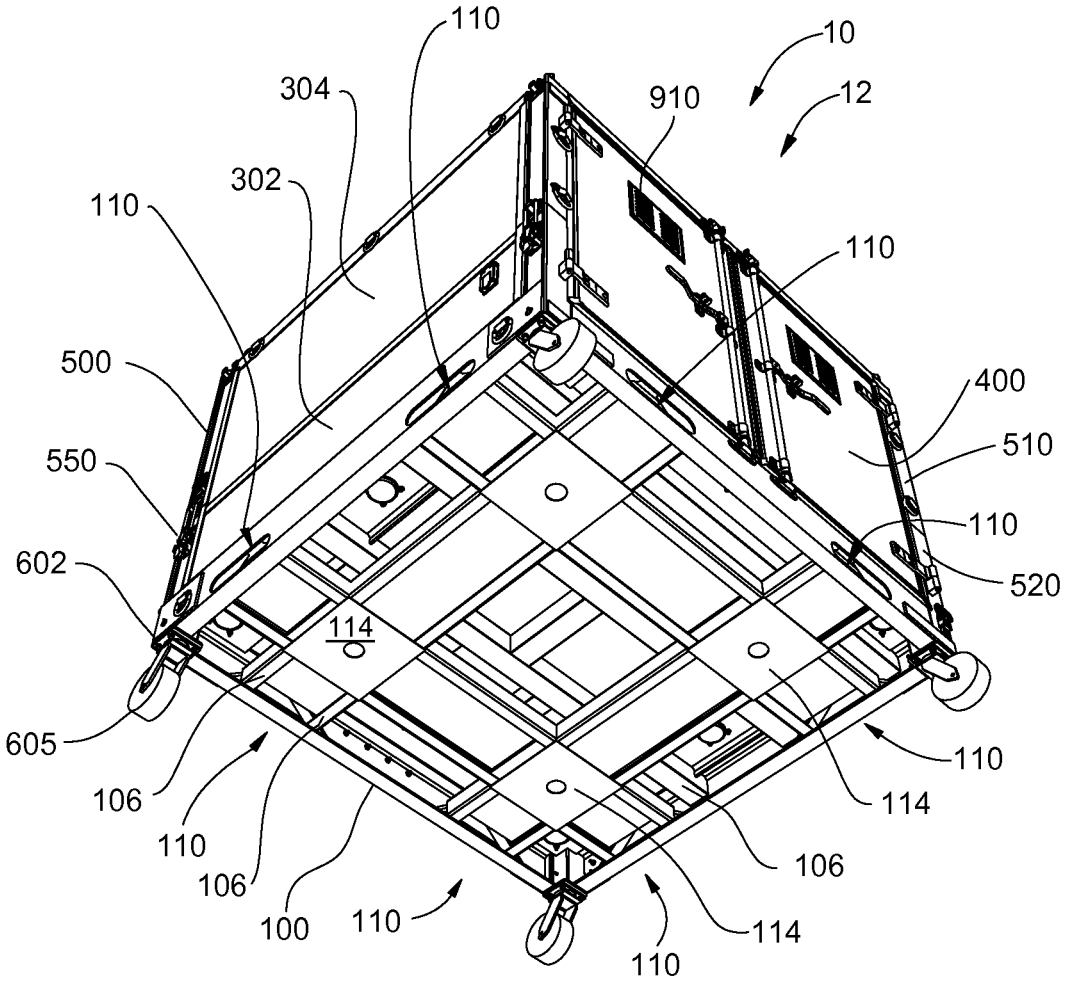
FIG. 11 is a perspective view of a bottom portion of the collapsible container of FIG. 1.
Figure 12:
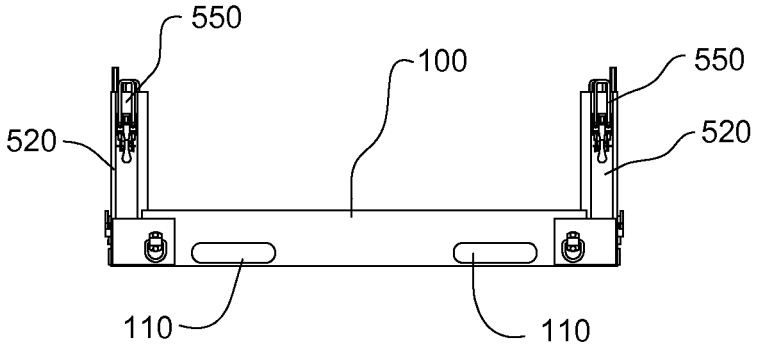
FIG. 12 is a side elevational view of a bottom portion and of associated corner post lower sections of a portion of the collapsible container of FIG. 1.
Figure 13:
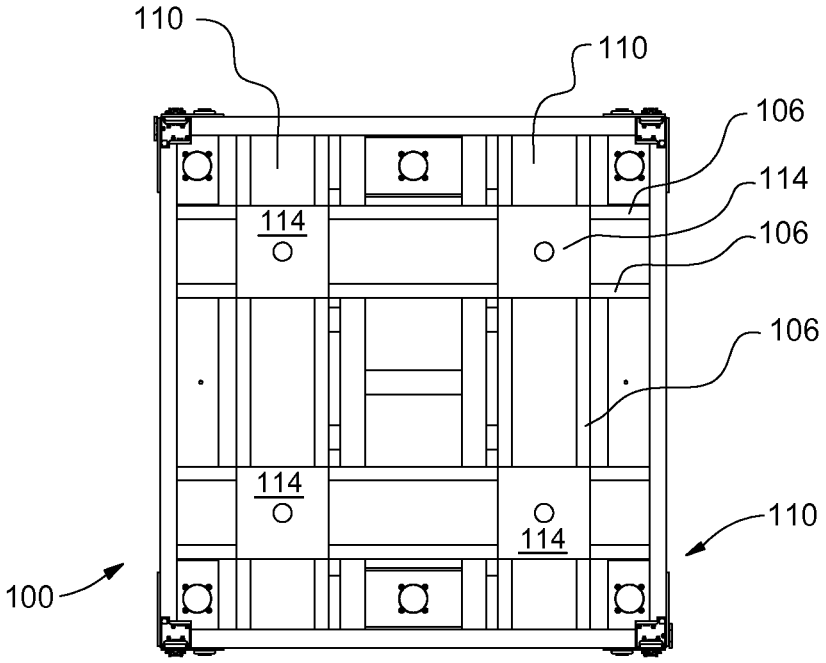
FIG. 13 is a bottom plan view of the collapsible container of FIG. 1.

FIG. 11, FIG. 12 and FIG. 13 illustrate the floor portion 100 of the container 10. As discussed above, the floor portion 100 is provided with four pairs of forklift openings 110, one pair on each side of the floor portion 100. All the openings 110 are disposed at the same level on the floor portion 100. This requires a particular frame members 106 arrangement to procure sufficient strength to support the required cargo weight. Each forklift opening 110 is defined with one frame member 106 on each side. The series of frame members 106 are interconnected with junction members 114 adapted to distribute the stress of loaded frame members 106 on the entire floor portion 100 while allowing forklift openings 110 channels to cross.

Figure 14:
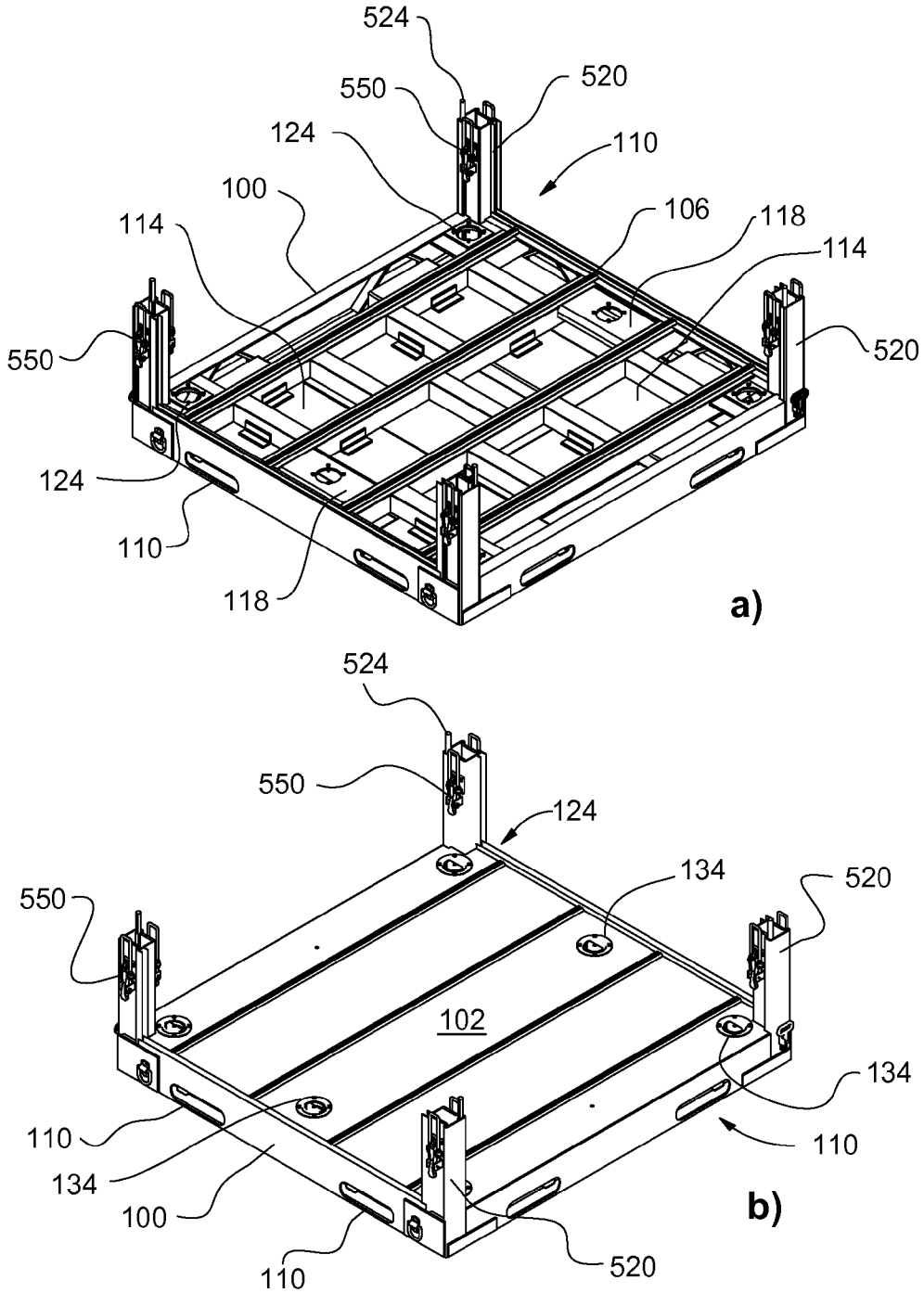
FIG. 14*a*) is a perspective view of a bottom portion and of associated corner post lower sections of a portion of the collapsible container of FIG. 1 with the floor cover removed to see the underneath structure thereof in accordance with an embodiment of the present invention.
FIG. 14*b*) is a perspective view of a bottom portion and of associated corner post lower sections of a portion of the collapsible container of FIG. 1 with the floor cover installed in accordance with an embodiment of the present invention.
Figure 15:
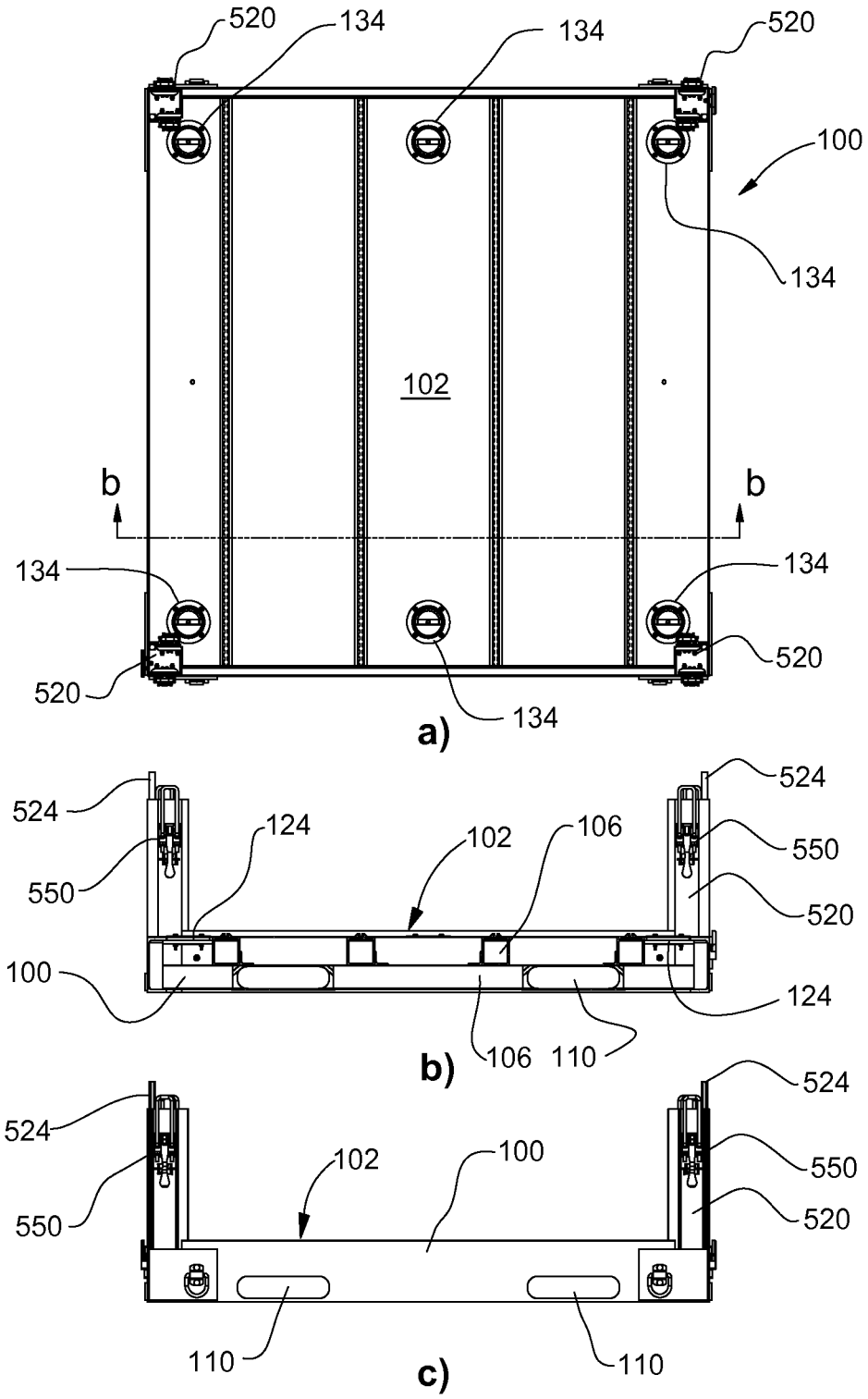
FIG. 15*a*) is a top plan view of the floor portion of the collapsible container of FIG. 1 with the wall portions and the door portions removed.
FIG. 15*b*) is a side elevational sectional view of the floor portion shown on FIG. 15*a*)
FIG. 15*c*) is a side elevational view of the floor portion shown on FIG. 15*a*)

Reinforcement members 118 are disposed on the floor portion 110 between frame members 106 to receive retaining rings 134 as illustrated on FIGS. 14*a*) and 14*b*). Wheel receiving members 124 are also provided on each corner to transfer the load of the wheels 600 (not shown on FIGS. 14*a*) and 14*b*) but shown on FIG. 1, inter alia) to the structure of the floor portion 100. FIGS. 15*a*) and 15*b*) further illustrate the structure of the floor portion 100.

Figure 16:
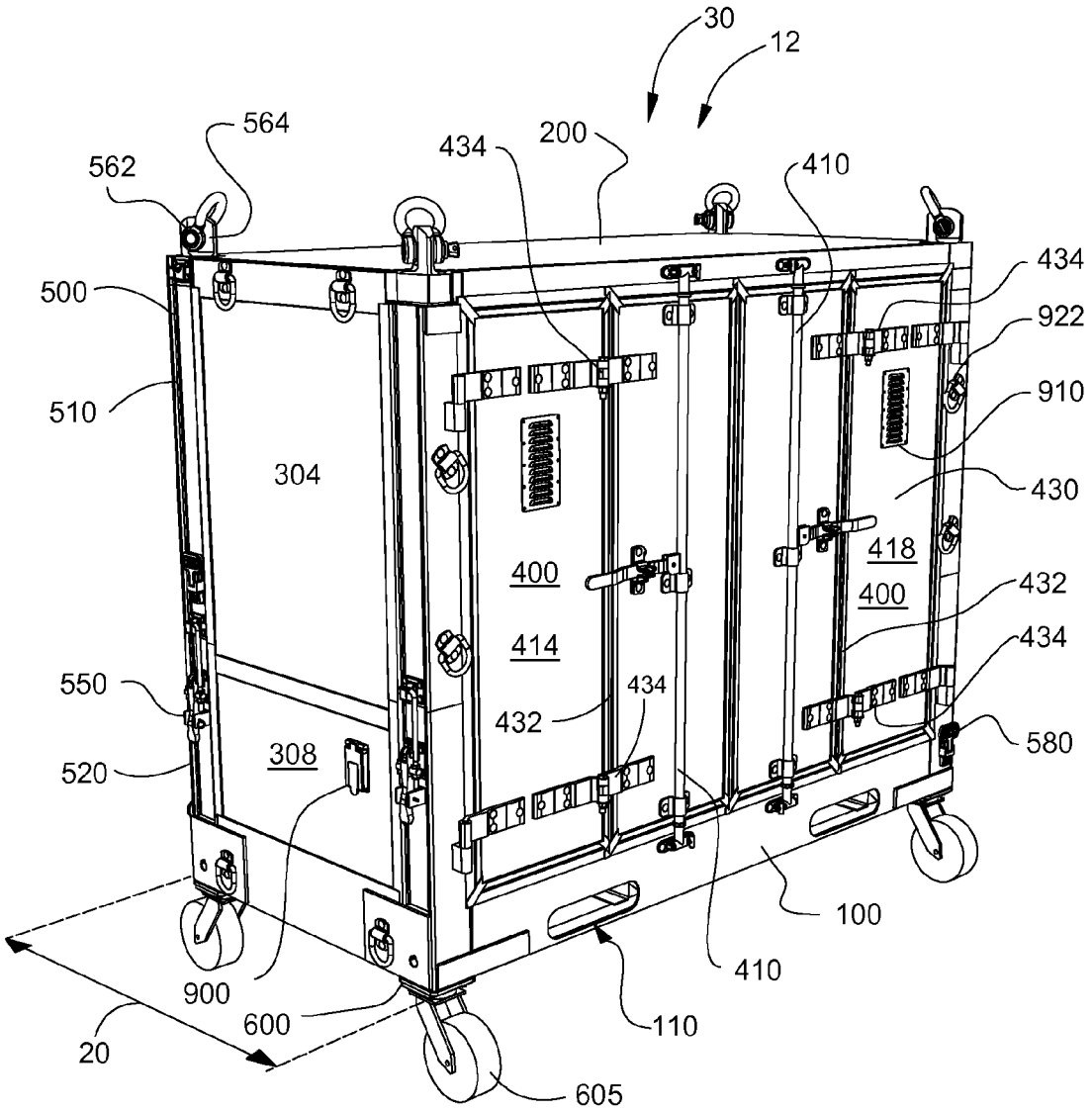
FIG. 16 is a perspective view of a mini-collapsible container, in its expanded configuration, in accordance with one embodiment of the present invention.

As it can be appreciated on FIG. 16, a collapsible container 30 of a different size than the container 10 illustrated on FIG. 1 is shown. The miniature collapsible container 30 generally shares a similar structure with the full size container 10 despite its floor area is about half the size of the full size container 10.

The miniature container 30 is an illustrative example of a possible collapsible container of a different size that is part of a family of collapsible containers. A larger collapsible container is therefore encompassed by the present illustrative embodiment despite it is not illustrated.

Figure 17:
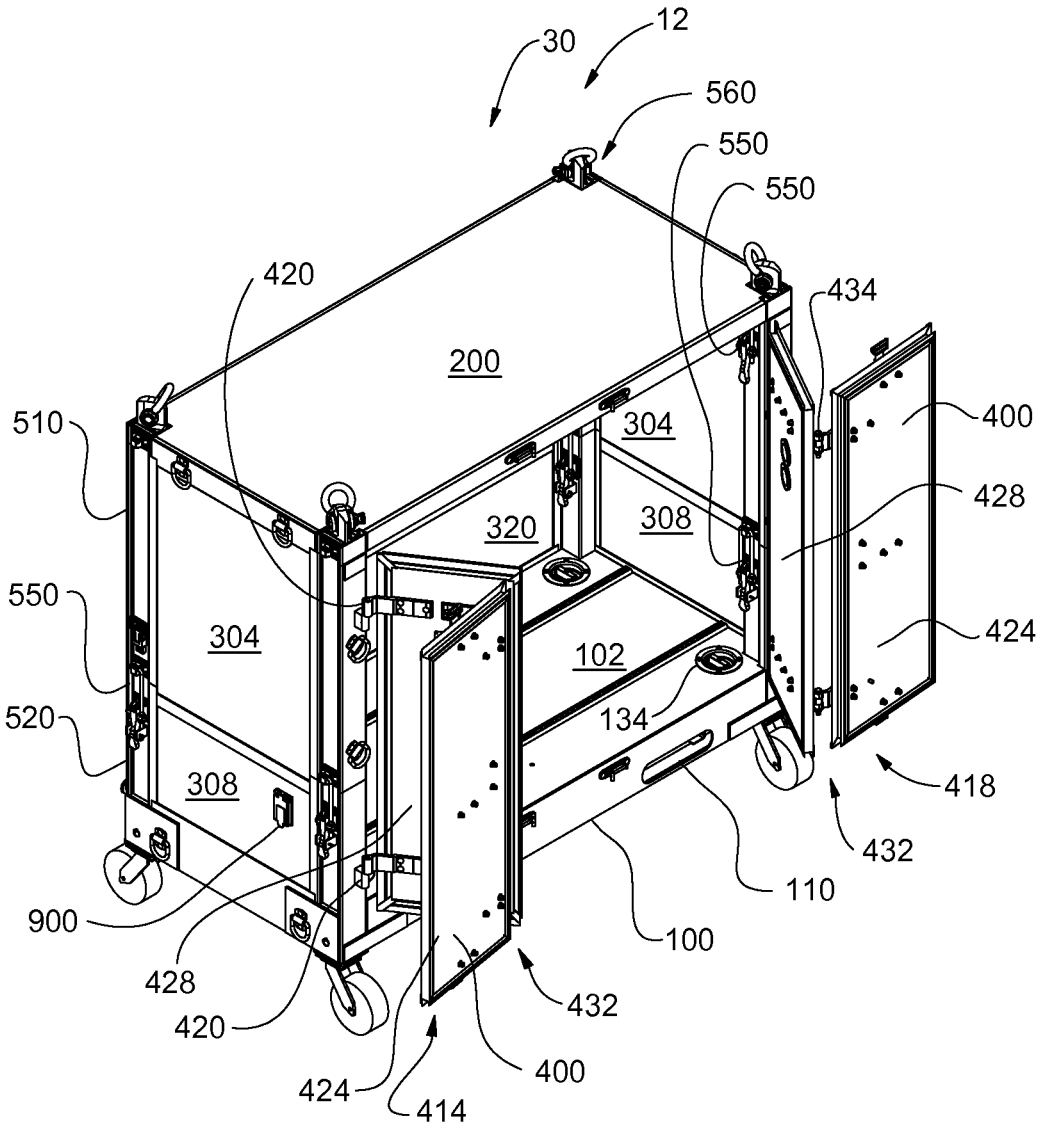
FIG. 17 is an alternate perspective view of the mini-collapsible container of FIG. 16.
Figure 18:
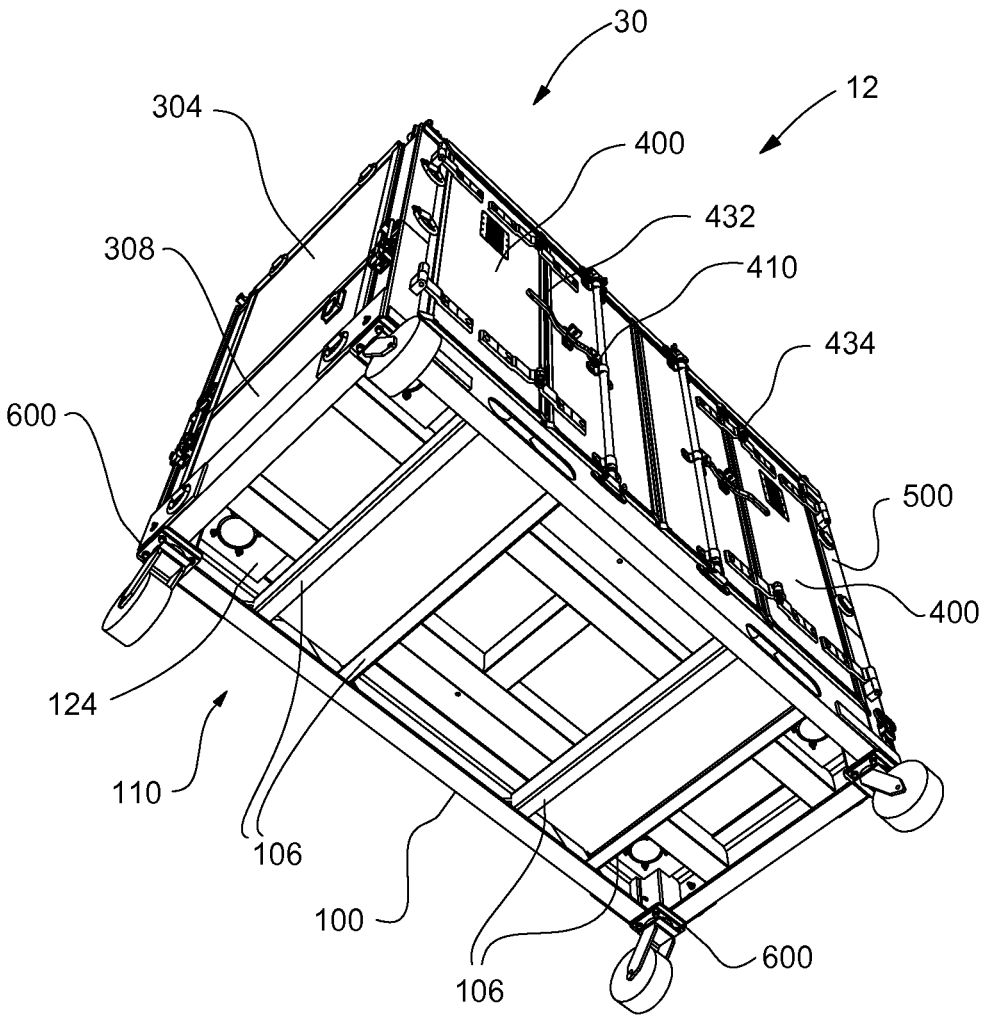
FIG. 18 is a perspective view of a bottom of the mini-collapsible container of FIG. 16.

Still referring to FIG. 16, in conjunction with FIG. 17 and FIG. 18, the miniature 30 collapsible container has a floor portion 100 that is about half the size of the floor portion 100 of the full size collapsible container 10 as previously described. The height remains similar to the height of a full size collapsible container 10. The doors 400 (414, 418) are located along the longer side of the floor portion 100. Only one set of doors 414, 418 are preferably installed given the reduced size of the miniature container 30. The opposite side is closed by a wall portion 320—that is better seen on FIG. 17.

FIG. 17 also shows articulated doors 430. Articulated doors 400 are provided to allow to open the miniature container 30 in narrow spaces. Each door 414, 418 is provided with two door panels, a proximal panel 424 and a distal panel 428. Each proximal door panel 424 is hingedly connected 434 to the distal panel 428 (that create a fold 432) that itself is hingedly connected 420 to a corner post 500. The doors 400 are removable from their hinge 420 by lifting the door 400 in the open position such that hinges 420 are disconnecting. The full size container 10 can also receive articulated doors 414, 418 without departing from the present invention.

Only two forklift openings 110 are provided on the floor portion 100 of the miniature collapsible container 30 given its narrower shape, as it is shown on FIG. 18.

Also visible on FIG. 16 is an electric outlet 900. The electric outlet 900 provides electrical connection to/from the container 10. The outlet can accommodate an electric plug or simply be an opening by which an electric wire can pass through. A skilled reader can also appreciate that the location and the number of electric outlet 900 can vary.

Additional potentially claimable subject matters:

The collapsible container of a preceding claim, wherein the clamp is a tool-less activation clamp.

The collapsible container of a preceding claim, wherein the clamp is two clamps, each one of the two claims being adapted to be disposed on two opposed sides of the post.

The collapsible container of a preceding claim, wherein the floor portion is provided with a pair of forklift openings, one pair of fork lift openings being disposed on each vertical side of the floor portion.

The collapsible container of a preceding claim, wherein the floor portion is adapted to receive a set of wheels.

The collapsible container of a preceding claim, wherein the set of wheels is removably mounted to the floor portion to support the collapsible container.

The collapsible container of a preceding claim, wherein the collapsible container is adapted to be mounted without a tool.

The collapsible container of a preceding claim, wherein the collapsible container is adapted to be assembled and disassembled without a tool.

The collapsible container of a preceding claim, further comprising a miniature collapsible container having a reduced floor portion area, wherein the at least two posts of the collapsible container, in the collapsed length configuration, being adapted to interconnect the ceiling portion of the miniature collapsible container to the floor portion of the miniature collapsible container when the miniature container is in the collapsed configuration and, in the expanded length configuration, being adapted to interconnect the ceiling portion of the miniature collapsible container to the floor portion of the miniature collapsible container when the miniature container is in the expanded configuration.

The collapsible container of a preceding claim, wherein the miniature collapsible container is adapted to be provided with at least one articulated door portion.

The collapsible container kit of a preceding claim, wherein the four posts in the collapsed length configuration and the four posts in the expanded length configuration are distinct posts.

The collapsible container kit of a preceding claim, wherein the upper section is adapted to be secured to the post in the collapsed length configuration.

The collapsible container kit of a preceding claim, wherein the clamp is a tool-less activation clamp.

The collapsible container kit of a preceding claim, wherein the clamp is two clamps, each one of the two claims being adapted to be disposed on two opposed sides of the post.

The collapsible container kit of a preceding claim, wherein the post is defining a recess adapted to receive the clamp.

The collapsible container kit of a preceding claim, wherein a connector extends from the upper section, the connector being adapted to suspend the collapsible container.

The collapsible container kit of a preceding claim, wherein a male-female interface is disposed between the post in the collapsed length configuration and the upper section to further secure the post in the collapsed length configuration with the upper section to define the post in the expanded length configuration.

The collapsible container kit of a preceding claim, wherein the male-female interface is provided with a low friction material disposed between the post in the collapsed length configuration and the upper section to facilitate a mating assembly of the male-female interface.

The collapsible container kit of a preceding claim, wherein the at least one wall portion, adapted to be disposed between the floor portion and the ceiling portion, is a low wall portion and a high wall portion, the low wall portion being adapted to be installed between two posts in the collapsed length configuration between the floor portion and the ceiling portion when the collapsible container is assembled in the collapsed position.

The collapsible container kit of a preceding claim, wherein the floor portion is provided with a pair of forklift openings, one pair of fork lift openings being disposed on each vertical side of the floor portion.

The collapsible container kit of a preceding claim, wherein the floor portion is adapted to receive a set of wheels.

The collapsible container kit of a preceding claim, wherein the set of wheels is removably mounted to the floor portion to support the collapsible container.

The collapsible container kit of a preceding claim, wherein the collapsible container is adapted to be mounted without a tool.

The collapsible container kit of a preceding claim, wherein the collapsible container is adapted to be assembled and disassembled without a tool.

The collapsible container kit of a preceding claim, further comprising a miniature collapsible container having a reduced floor portion area, wherein the at least two posts of the collapsible container, in the collapsed length configuration, being adapted to interconnect the ceiling portion of the miniature collapsible container to the floor portion of the miniature collapsible container when the miniature container is in the collapsed configuration and, in the expanded length configuration, being adapted to interconnect the ceiling portion of the miniature collapsible container to the floor portion of the miniature collapsible container when the miniature container is in the expanded configuration.

The collapsible container kit of a preceding claim, wherein the miniature collapsible container is adapted to be provided with at least one articulated door portion.

The method of shipping collapsible containers of a preceding claim, further comprising vertically staking at least two collapsible containers, wherein a vertical height of at least two collapsed collapsible containers being less or equal to a vertical height of a single expanded collapsible container.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A collapsible container having an expanded configuration and a collapsed configuration, the collapsible container comprising:

a floor portion;

a ceiling portion opposed to the floor portion;

at least one wall portion disposed between the floor portion and the ceiling portion;

at least one door portion disposed between the floor portion and the ceiling portion; and a plurality of posts, each post including a lower portion comprising four walls, secured to the floor portion at a first end thereof for a collapsed length configuration thereof, and a removable upper portion adapted to be longitudinally assembled and secured, at a first end thereof, to a second end of the lower portion, for extending the post in an expanded length configuration, the upper portion being adapted to be secured to the lower portion with at least one securing element longitudinally securing the upper portion to the lower portion by longitudinally pulling the upper portion toward the bottom portion to limit and prevent relative longitudinal movement between the lower portion and upper portion, wherein each of the plurality of posts in the expanded length configuration includes a lifting anchor at a second end of the upper portion, the plurality of posts, in the collapsed length configuration, being adapted to interconnect the ceiling portion to the floor portion when the collapsible container is in the collapsed configuration and, in the expanded length configuration, being adapted to interconnect the ceiling portion to the floor portion when the collapsible container is in the expanded configuration, wherein the collapsible container in the expanded configuration is adapted to be suspended by the lifting anchors extending over the ceiling portion.

2. The collapsible container of claim 1, wherein the collapsible container is stackable.

3. The collapsible container of claim 1, wherein the plurality of posts in the collapsed length configuration are permanently secured to the floor portion.

4. The collapsible container of claim 1, wherein the at least one securing element is a pair of opposed securing elements longitudinally securing the upper portion to the lower portion.

5. The collapsible container of claim 4, wherein one of the pair of opposed securing elements is disposed on a lateral side of the container.

6. The collapsible container of claim 4, wherein one of the pair of opposed securing elements is disposed inside the container whereby the upper portion is disconnectable from the lower portion when the interior of the container is accessible.

7. The collapsible container of claim 4, wherein the pair of opposed securing elements are laterally offset and are not exactly facing each other.

8. The collapsible container of claim 1, wherein the securing element is a clamp adapted to be actuated without a tool.

9. The collapsible container of claim 8, wherein the post includes a longitudinal recess portion adapted to receive at least a portion of the clamp therein.

10. The collapsible container of claim 1, wherein the lifting anchor is a connector extending from the post section above the ceiling portion, the connector being adapted to suspend the collapsible container.

11. The collapsible container of claim 1, wherein a male-female interface is provided between the lower portion and the upper portion of the post to further secure the lower portion and the upper portion of the post.

12. The collapsible container of claim 11, wherein the male-female interface is provided with a low friction polymer material to facilitate a mating assembly of the male-female interface.

13. The collapsible container of claim 1, wherein the posts respectively include a centering member adapted to locate the additional post section.

14. A collapsible container kit comprising:

a floor portion;

a ceiling portion adapted to be mounted in parallel opposition to the floor portion;

at least one wall portion adapted to be mounted between the floor portion and the ceiling portion;

at least one door portion adapted to be pivotably disposed between the floor portion and the ceiling portion; and four posts, each post including a lower portion comprising four walls, secured to the floor portion at a first end thereof for a collapsed length configuration thereof, and a removable upper portion adapted to be longitudinally assembled and secured, at a first end thereof, to a second end of the lower portion, for extending the post in an expanded length configuration, the upper portion being adapted to be secured to the lower portion with at least one securing element longitudinally securing the upper portion to the lower portion by longitudinally pulling the upper portion toward the bottom portion to limit and prevent relative longitudinal movement between the lower portion and upper portion, wherein each of the four posts in the expanded length configuration includes a lifting anchor at a second end thereof, the four posts, in the collapsed length configuration, being adapted to interconnect the ceiling portion with the floor portion when the container is in the collapsed configuration and, in the expanded length configuration, being adapted to interconnect the ceiling portion with the floor portion when the container is in the expanded configuration, wherein the collapsible container in the expanded configuration is adapted to be suspended by the lifting anchors extending from the ceiling portion.

15. The collapsible container kit of claim 14, wherein the at least one securing element is a pair of opposed securing elements longitudinally securing the upper portion to the lower portion.

16. The collapsible container kit of claim 15, wherein one of the pair of opposed securing elements is disposed on a lateral side of the post.

17. The collapsible container kit of claim 16, wherein the securing element is a clamp adapted to be actuated without a tool.

18. A method of assembling an expandable container having an expanded configuration and a collapsed configuration, the method comprising:

providing a floor portion;

providing a ceiling portion in a position opposed to the floor portion;

providing at least one wall portion disposed between the floor portion and the ceiling portion;

providing at least one door portion disposed between the floor portion and the ceiling portion;

providing a plurality of posts each post including a lower portion comprising four walls, secured to the floor, at a first end thereof, in a collapsed length configuration thereof;

longitudinally assembling a removable upper portion to each of the lower portions;

longitudinally securing each of the upper portions with respective lower portions with at least one securing element longitudinally assembling and securing the upper portion, at a first end thereof, to a second end of the lower portion, for extending the post in an expanded length configuration, the upper portion being adapted to be secured to the lower portion with the at least one securing element longitudinally securing the upper portion to the lower portion by longitudinally pulling the upper portion toward the bottom portion to limit and prevent relative longitudinal movement between the lower portion and upper portion, wherein each of the plurality of posts in the expanded length configuration includes a lifting anchor at a second end thereof, and interconnecting the ceiling portion to the floor portion with the plurality of posts in their expanded length configuration to provide the collapsible container in the expanded configuration, the plurality of posts in the expanded length configuration being further adapted to secure the ceiling portion by extending the lifting anchors through the ceiling portion, wherein the collapsible container in the expanded configuration is adapted to be suspended by the lifting anchors extending over the ceiling portion.

19. The method of assembling an expandable container of claim 18, wherein the securing element is a clamp adapted to be manually actuated and wherein the method further comprising manually actuating the clamp.

20. The collapsible container of claim 17, wherein the post includes a longitudinal recess portion adapted to receive at least a portion of the clamp therein.

* * * * *